US009309614B2

(12) United States Patent
Lawley

(10) Patent No.: US 9,309,614 B2
(45) Date of Patent: Apr. 12, 2016

(54) STITCH PATTERN AND METHOD OF EMBROIDERING

(75) Inventor: Larry Curtis Lawley, Weatherford, TX (US)

(73) Assignee: Data Stitch, Inc., Weatherford, TX (US)

( * ) Notice: Subject to any disclaimer, the term of this patent is extended or adjusted under 35 U.S.C. 154(b) by 945 days.

(21) Appl. No.: 13/412,274

(22) Filed: Mar. 5, 2012

(65) Prior Publication Data

US 2012/0222605 A1 Sep. 6, 2012

Related U.S. Application Data

(60) Provisional application No. 61/464,342, filed on Mar. 3, 2011.

(51) Int. Cl.

| | |
|---|---|
| ***D05C 7/08*** | (2006.01) |
| ***D05B 35/06*** | (2006.01) |
| ***D05C 7/02*** | (2006.01) |

(52) U.S. Cl.

CPC *D05C 7/08* (2013.01); *D05B 35/06* (2013.01); *D05C 7/02* (2013.01); *D05D 2305/08* (2013.01)

(58) Field of Classification Search

CPC ..... D05C 7/08; D05C 7/02; D05B 35/06; D05D 2305/08

USPC ..... 112/439, 440, 441, 475.18, 475.21

See application file for complete search history.

(56) References Cited

U.S. PATENT DOCUMENTS

| | | | | | |
|---|---|---|---|---|---|
| 1,646,383 | A * | 10/1927 | Becker | 112/437 |
| 1,723,729 | A * | 8/1929 | Goldberg | 428/51 |
| 2,456,264 | A * | 12/1948 | Friedlen | 28/164 |
| 3,794,554 | A * | 2/1974 | Caring | 428/43 |
| 4,103,634 | A * | 8/1978 | Schachter | 112/439 |
| 4,427,472 | A * | 1/1984 | Trager | 156/93 |
| 4,646,666 | A * | 3/1987 | Burrier | 112/475.22 |
| 5,005,219 | A * | 4/1991 | Diaz | 2/244 |
| 5,241,919 | A * | 9/1993 | LaGreca | 112/410 |
| 5,399,410 | A * | 3/1995 | Urase et al. | 428/102 |
| 5,531,176 | A * | 7/1996 | Johnson | 112/475.24 |
| 5,537,939 | A * | 7/1996 | Horton | 112/475.19 |
| 5,758,588 | A * | 6/1998 | Orfali | 112/475.08 |
| 5,832,854 | A * | 11/1998 | Lin et al. | 112/475.22 |
| 5,974,997 | A * | 11/1999 | Amburgey | 112/475.01 |
| 6,155,189 | A * | 12/2000 | Walner | 112/475.01 |
| 6,718,895 | B1 * | 4/2004 | Fortuna | 112/475.19 |
| 7,137,149 | B2 * | 11/2006 | Kronenberger | 2/195.1 |
| 7,212,880 | B2 * | 5/2007 | Mizuno et al. | 700/138 |
| 7,237,498 | B2 * | 7/2007 | Kronenberger | 112/475.09 |
| 7,430,975 | B2 * | 10/2008 | Kronenberger | 112/475.09 |
| 7,882,645 | B2 * | 2/2011 | Boring | 33/562 |
| 8,606,390 | B2 * | 12/2013 | Hjalmarsson et al. | 700/138 |
| 8,667,616 | B2 * | 3/2014 | Kronenberger | 2/244 |

(Continued)

*Primary Examiner* — Danny Worrell

(74) *Attorney, Agent, or Firm* — Bracewell LLP

(57) ABSTRACT

An embroidery sewing appliqué technique. A tacking stitch is produced and positioned inside a column of a fabric that holds down the fabric on top of a base or host material, such as a garment. Running parallel to the tacking stitch, a column or satin stitch runs near and to the outside of the tacking stitch. The column or satin stitch has a higher density than that utilized in normal embroidery applications. The higher density satin stitch varies with needle size and thread size. The satin stitch cuts the fabric along the outer edge of the fabric. The tack stitch on the inside of the satin stitch locks the fabric down therefore not allowing the inner edge of the satin to be lifted away from the garment by virtue of the running tack stitch and without a separate cutting step.

16 Claims, 4 Drawing Sheets

(56) References Cited

U.S. PATENT DOCUMENTS

2004/0244663 A1* 12/2004 Burrell et al. ..... 112/475.17
2005/0211147 A1* 9/2005 Waterfield ..... 112/475.18
2010/0050915 A1* 3/2010 Konig ..... D05C 7/04 112/89

* cited by examiner

STITCH PATTERN AND METHOD OF EMBROIDERING

CROSS-REFERENCE TO RELATED APPLICATION

This application claims priority to provisional application 61/464,342, filed Mar. 3, 2011.

FIELD OF THE INVENTION

This technique relates in general to embroidery machines, and in particular to an embroidery machine that can apply layers of material via appliqué.

BACKGROUND OF THE INVENTION

An embroidery machine may be used to apply one or more layers of material on top of a base or host material. An embroidery technique that may be employed by such machines to apply layers of material is commonly known as "appliqué." In its broadest sense, an appliqué is a smaller ornament or device applied to another surface. Embroidery machines may be computerized and may utilize computer numerical control ("CNC") to achieve a desired appliqué.

When applying an appliqué via a computerized embroidery process, excess appliqué material must be cut away either before or after application of the stitching. Further, current appliqué techniques cannot be utilized to decorate pre-constructed items such as headwear or caps, which have varying surfaces.

A need exists for a technique that eliminates or reduce the cutting of excess material during the appliqué process to make the process more efficient and less costly. Further, a need exists for further flexibility to decorate more types of fully constructed apparel and accessory items. The following technique may solve one or more of these problems.

SUMMARY OF THE INVENTION

In an embodiment of the present technique, an embroidery machine may apply one or more layers of material, such as fabric, on top of a base or host material via an embroidery technique known as "appliqué." The base may be, for example, another fabric layer, a garment, or headwear. The embroidery machine may utilize computer numerical control ("CNC") to receive instructions to thereby achieve a desired appliqué.

Once the layer of fabric is placed and oriented on the base, a stitch can be created and positioned inside a column or edge of the fabric layer. The stitch may be created continuously such that a beginning and end of the stitch coincide. The stitch creates a tacking stitch that holds the fabric onto at least one side of fabric or garment. The tacking stitch may be used temporarily to hold the fabric onto the garment. The fabric may include, but is not limited to, cotton, polyester, mesh, rayon, or combinations thereof.

Running parallel to the tacking stitch, a column or satin stitch runs near and to the outside of the tacking stitch. The column or satin stitch has a density that is of higher density than normal applications, resulting in closely spaced needle penetrations. In embroidery, a satin stitch is a series of flat stitches that are used to completely cover a section of the base material. Narrow rows of satin stitch can be executed on an embroidery machine using a zig-zag stitch. Although satin stitches are discussed herein, other types of stitches may also be utilized, for example without limitation, brick stitch, encroaching sating stitch, long-and-short stitch, and padded satin stitch.

This higher density varies with needle size and thread size used with the embroidery machine. Due to higher density of the satin stitch, the satin stitch cuts the fabric along the outer edge outside of the tacking stitch. The distance of the satin stitch from the tacking stitch may be established by the operator depending on the amount of fabric to be cut. As previously described, the tack stitch on the inside of the satin stitch locks the fabric down to the base, thereby preventing the inner edge of the satin to be lifted away from the garment due to the running tack stitch. Both the tacking and satin stitch location and spacing may be established and entered into the embroidery machine's CNC program.

The appliqué technique above advantageously holds the fabric layer or layers onto the base and advantageously cuts the excess material for removal by pulling away, eliminating a separate cutting procedure.

In another embodiment of the present invention, a layer of fabric can be placed and oriented on a non-flat surface such as a cap or other headwear, for example. A stitch can be created and positioned inside a column or edge of the fabric layer. The stitch may be created continuously such that a beginning and end of the stitch coincide. The stitch creates a tacking stitch that holds the fabric onto the cap.

A column or satin stitch runs near and to the outside of the tacking stitch. The column or satin stitch has a density that is of higher density than normal applications, resulting in closely spaced needle penetrations. This higher density varies with needle size and thread size used with the embroidery machine. Due to higher density of the satin stitch, the satin stitch cuts the fabric along the outer edge outside of the tacking stitch. As previously stated, both the tacking and satin stitch location and spacing may be established and entered into the embroidery machine's CNC program.

BRIEF DESCRIPTION OF THE DRAWINGS

So that the manner in which the features and benefits of the technique, as well as others which will become apparent, may be understood in more detail, a more particular description of the technique briefly summarized above may be had by reference to the embodiments thereof which are illustrated in the appended drawings, which form a part of this specification. It is also to be noted, however, that the drawings illustrate only various embodiments of the technique and are therefore not to be considered limiting of the technique's scope as it may include other effective embodiments as well.

DETAILED DESCRIPTION OF THE INVENTION

The present technique now will be described more fully hereinafter with reference to the accompanying drawings in which a preferred embodiment of the technique is shown. This technique may, however, be embodied in many different forms and should not be construed as limited to the embodiment set forth herein; rather, this embodiment is provided so that this disclosure will be thorough and complete, and will fully convey the scope of the technique to those skilled in the art. Like numbers refer to like elements throughout.

Figure 1:
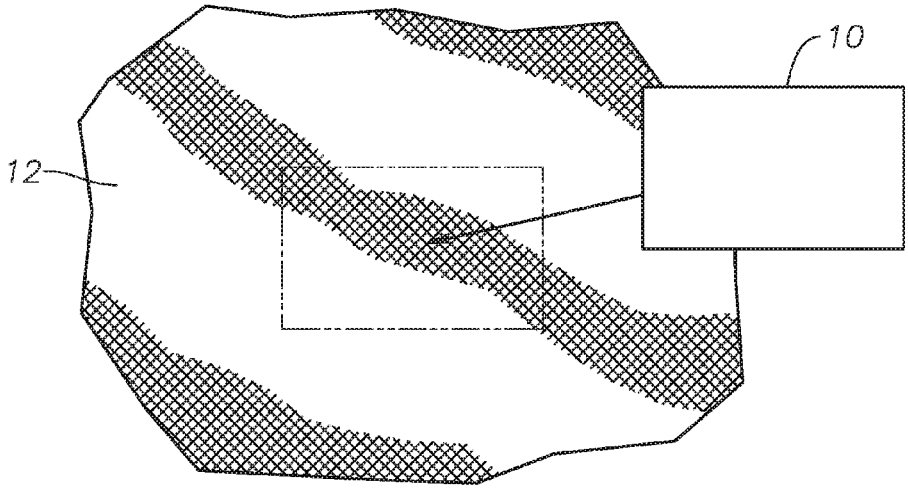
FIG. 1 is a perspective view illustrating a layer of fabric to be embroidered onto a surface, in accordance with the technique of this invention.

Referring to FIG. 1, a layer of fabric 10 is placed on a base, surface, or host material 12 to undergo embroidery via a technique known as "appliqué." Although the fabric 10 is shown as having a rectangular shape, it is understood that the fabric 10 may have various other geometric shapes. Further, a plurality of the layers of fabric 10 may be placed on the surface 12. The fabric 10 may include, but is not limited to, cotton, polyester, mesh, rayon, or combinations thereof. In certain embodiments, a preferred material for the fabric 10 may be a non-woven, man-made material, such as polyester PVC blends, that facilitates penetration by an embroidery needle. In addition, the fabric 10 may be of different colors or combinations of colors and may have indicia. The base may be, for example, another fabric layer, a garment, or headwear.

Figure 2:
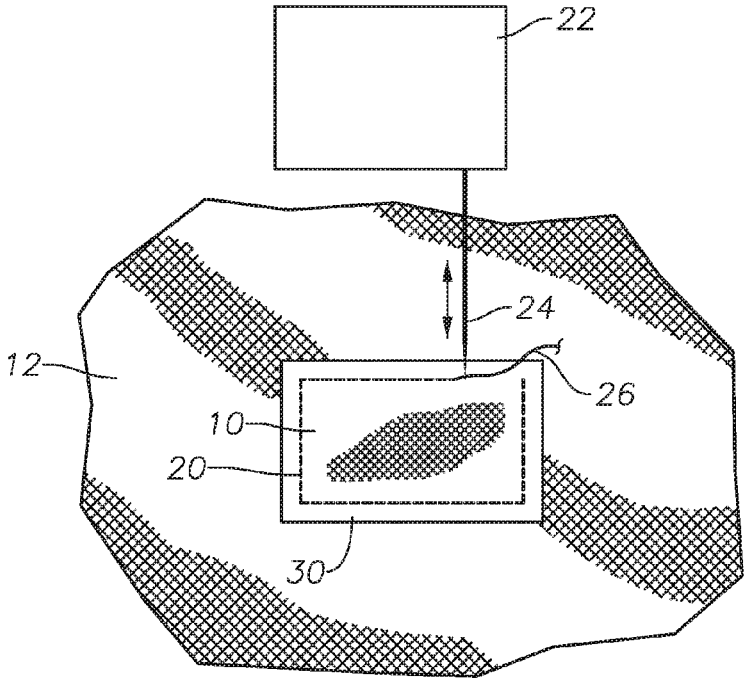
FIG. 2 is a plan view illustrating the layer of fabric of FIG. 1 with a tack stitch holding the fabric to the surface, in accordance with the technique of this invention.

Referring to FIG. 2, the layer of fabric 10 is shown attached to the base 12 via a stitch or tack stitch 20. To realize the tack stitch 20, an embroidery machine 22 reciprocates at least one needle 24 to puncture the fabric 10 and the base and thread a strand of material 26 that joins the fabric 10 to the base 12. The tack stitch 20 may be created continuously such that a beginning and end of the stitch 20 coincide. The embroidery machine 22 may utilize computer numerical control ("CNC") via which code can instruct the machine as to the desired appliqué. In this embodiment, the tack stitch 20 is created and positioned inside a column or edge 30 of the fabric layer 10.

Figure 3:
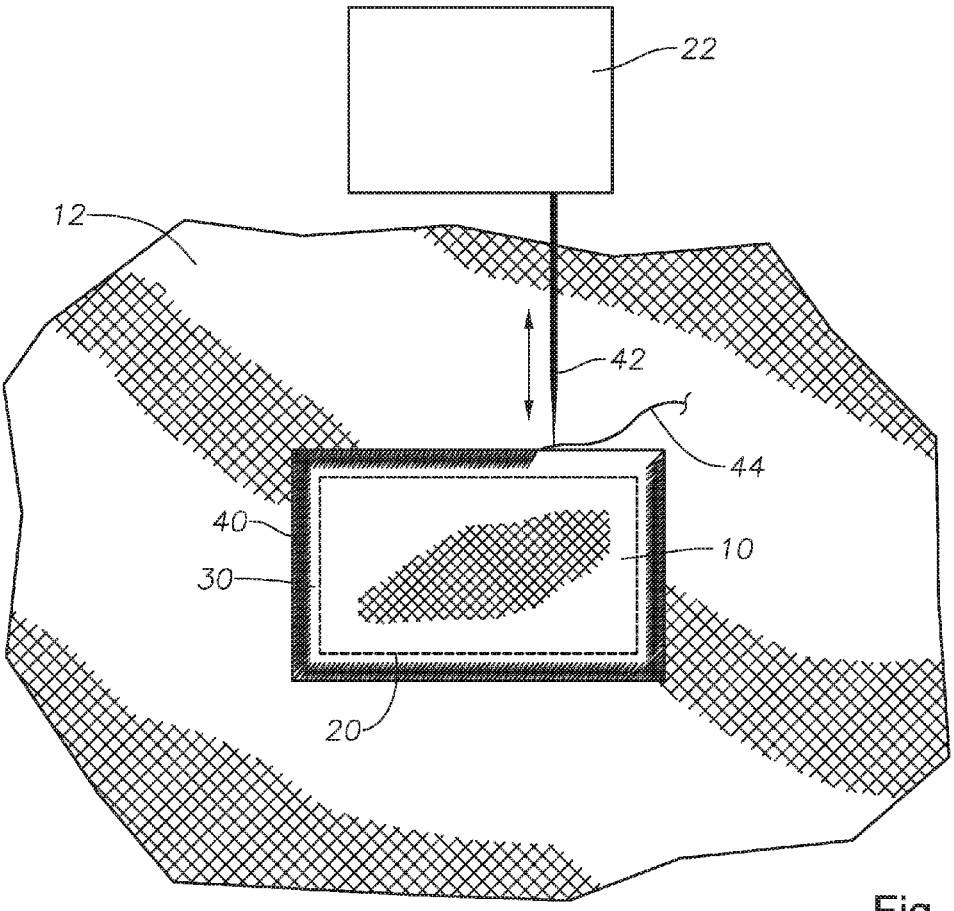
FIG. 3 is a plan view illustrating the layer of fabric of FIG. 1 with a satin stitch outside of the tack stitch, in accordance with the technique of this invention.
Figure 4:
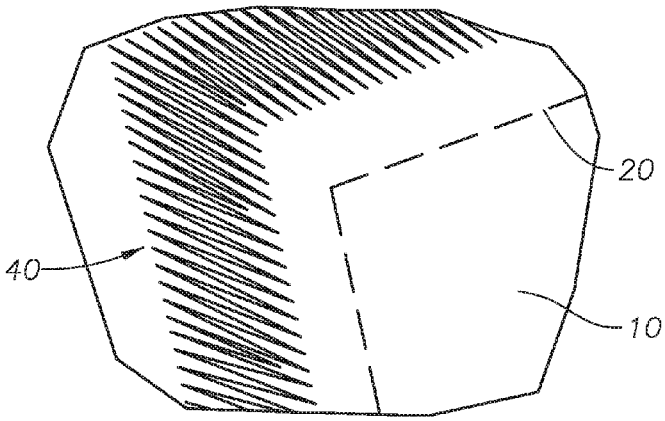
FIG. 4 is an enlarged plan view of the tack stitch and the satin stitch on the layer of fabric shown in FIG. 3, in accordance with the technique of this invention.

Referring to FIG. 3, running parallel to the tacking stitch 20, in this embodiment, a column or satin stitch 40 runs near and to the outside of the tacking stitch 20. The column or satin stitch 40 has a density that is of higher density than normal applications, resulting in closely spaced needle penetrations, as can be seen in FIG. 4. In some embodiments, the density of the satin stitch 40 may be approximately 10 to 200 stitches per square inch. However, the density of the satin stitch 40 may vary depending on the material of the fabric 10. To realize the satin stitch 40, the embroidery machine 22 reciprocates at least one needle 42 to puncture the outer column 30 of the fabric 10 with a strand of material, such as satin. The satin stitch 40 may be created continuously such that a beginning and end of the stitch 40 coincide. The embroidery machine 22 may utilize computer numerical control ("CNC") via which code can instruct the machine as to the desired spacing of the punctures.

Figure 5:
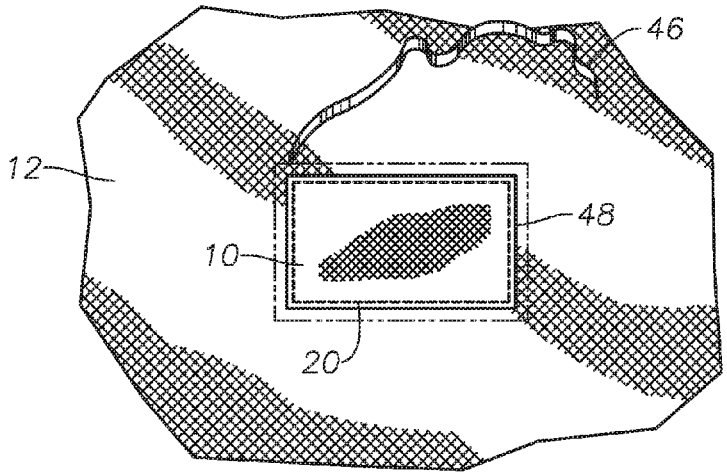
FIG. 5 is a plan view of the finished layer of FIG. 1 embroidered onto the surface, in accordance with the technique of this invention.

The satin stitch 40 has a higher density than the tack stitch 20 and may vary with needle size and thread size used with the embroidery machine 22. Due to higher density of the satin stitch 40, the satin stitch cuts the fabric 10 along the outer edge 30 outside of the tacking stitch 20, as shown in FIG. 5. The excess material 46 (FIG. 5) is removed without a separate cutting step. The distance of the satin stitch 40 from the tacking stitch 20 may be established by the operator depending on the amount of fabric 10 to be cut. As previously described, the tack stitch 20 on the inside of the satin stitch 40 locks or affixes the fabric 10 down to the base 12, thereby preventing the inner edge of the satin 40 to be lifted away from the base due to the running tack stitch 20. Both the tacking 20 and satin stitch 40 location and spacing may be established and entered into the embroidery machine's CNC program. As shown in FIG. 5, the fabric 10 has a new edge 48 that is proximally closer to the tack stitch 20 than the original column or edge 30 (FIG. 2). Once the satin stitch 40 is completed, the tacking stitch 20 may be removed because the satin stitch 20 serves to attach the fabric 10 to the base 12. The appliqué technique described above cuts appliqué material with the embroidery needle stitching a high-density column of stitches, i.e. the satin stitch 40. This appliqué method advantageously holds the appliqué material in place by use of a tacking stitch 20 placed at normal densities placed inside the perimeter of the high-density satin stitches 40.

Figure 6:
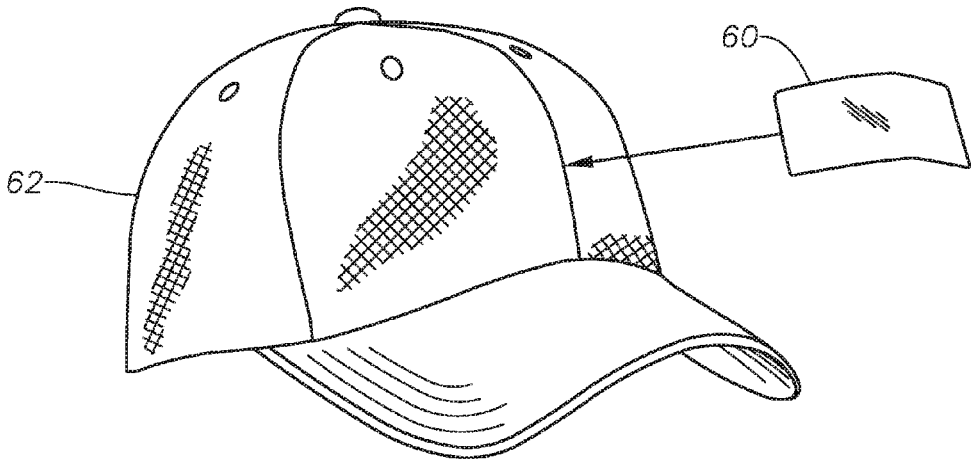
FIG. 6 is a perspective view illustrating a layer of fabric to be embroidered onto a cap, in accordance with the technique of this invention.
Figure 7:
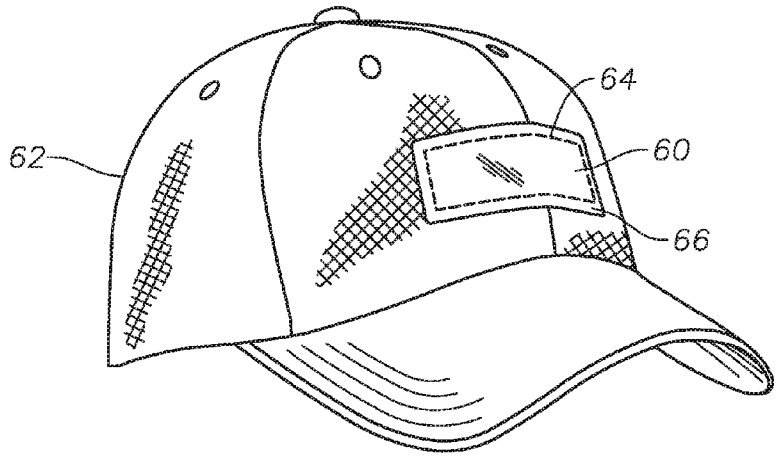
FIG. 7 is a plan view illustrating the layer of fabric of FIG. 6 with a tack stitch holding the fabric to the surface, in accordance with the technique of this invention.
Figure 8:
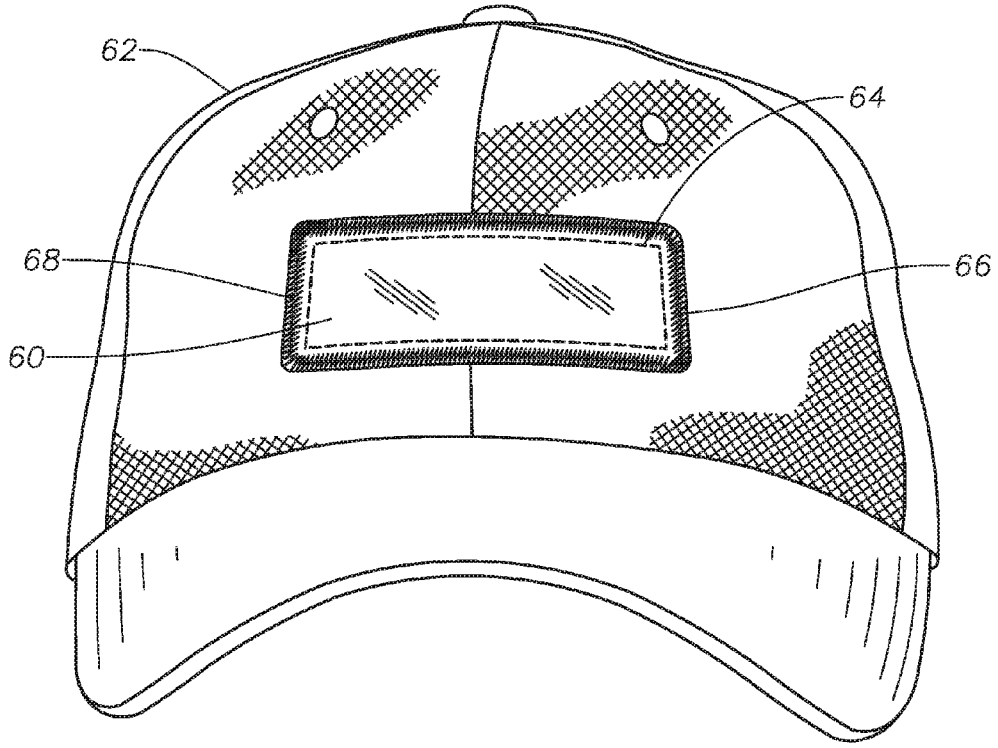
FIG. 8 is a plan view illustrating the layer of fabric of FIG. 6 with a satin stitch outside of the tack stitch, in accordance with the technique of this invention.

Referring to FIGS. 6-8, another embodiment of the present invention is illustrated. A layer of fabric 60 can be placed and oriented on a non-flat surface 62 such as a cap or other headwear, for example. A stitch 64 can be created and positioned inside a column or edge 66 of the fabric layer 60 by the embroidering machine 22 (FIG. 2). The stitch 64 may be created continuously such that a beginning and end of the stitch coincide. The stitch 64 creates a tacking stitch that holds the fabric 60 onto the surface 62 of the cap.

A column or satin stitch 68 runs near and to the outside of the tacking stitch 64. As previously discussed, the column or satin stitch 68 has a density that is of higher density than normal applications, resulting in closely spaced needle penetrations. This higher density varies with needle size and thread size used with the embroidery machine 22 (FIG. 2). Due to higher density of the satin stitch 68, the satin stitch cuts the fabric 60 along the outer edge 66 outside of the tacking stitch 64. As previously stated, both the tacking and satin stitch 64, 68 location and spacing may be established and entered into the embroidery machine's CNC program. Any excess material may be removed after the satin stitch 68 is complete.

In the drawings and specification, there have been disclosed a typical preferred embodiment of the technique, and although specific terms are employed, the terms are used in a descriptive sense only and not for purposes of limitation. The technique has been described in considerable detail with specific reference to these illustrated embodiments. It will be apparent, however, that various modifications and changes can be made within the spirit and scope of the technique as described in the foregoing specification and as set forth in the following claims.

The invention claimed is:

1. A stitch pattern comprising:

a tacking stitch applied to a layer of material located on a base material to maintain the layer of material in a position relative to the base material; and a cutting stitch applied with a threaded needle to a column of the layer of material, wherein the cutting stitch comprises a column of thread that circumscribes the tacking stitch and penetrates both the layer of material and the base material, severing the layer of material, and retaining the base material intact.

2. The stitch pattern of claim 1 wherein the cutting stitch is created by a satin stitch.

3. The stitch pattern of claim 1 wherein the cutting stitch has a density in the range of approximately 10 to 200 stitches per square inch.

4. The stitch pattern of claim 1 wherein the cutting stitch severs a portion of the layer of material along an outer edge of the layer of material.

5. The stitch pattern of claim 1 wherein the cutting stitch has a zig-zag pattern.

6. A method of embroidery comprising:

(a) placing a layer of material on a base material;

(b) creating a tacking stitch on the layer of material to hold the layer of material to the base material; and (c) creating a cutting stitch on the layer of material that circumscribes the tacking stitch, the cutting stitch including a column of thread that penetrates both the layer of material and the base material, severing the layer of material, and retaining the base material intact.

7. The method according to claim 6, further comprising the step of:

(d) entering instructions via a computerized embroidery machine to thereby instruct the machine on a specification describing the tacking stitch and the cutting stitch.

8. The method according to claim 6, wherein step (b) further comprises:

creating the tacking stitch in a closed shape.

9. The method according to claim 6, wherein step (c) further comprises:

selecting a desired needle size and a thread material for creating the cutting stitch.

10. The method according to claim 6, wherein step (c) further comprises:

selecting a sufficiently high density for the cutting stitch to achieve cutting of the layer of material.

11. The method according to claim 6, further comprising the step of severing and removing a portion of the layer of material.

12. The method according to claim 6, wherein the cutting stitch is created in a zig-zag pattern.

13. The stitch pattern of claim 1, wherein cutting stitch and the tacking stitch circumscribe an intact portion of the base material.

14. A method of embroidery comprising:

(a) placing a layer of material on a base material;

(b) securing the layer of material to the base material; and (c) creating a cutting stitch on the layer of material, the cutting stitch including a column of thread that penetrates both the layer of material and the base material that severs a portion of the layer of material along an outer edge of the layer of material and retains the base material intact.

15. The method according to claim 14, wherein step (b) includes creating a tacking stitch in a closed shape.

16. The method according to claim 14, wherein the step of severing a portion of the layer of material along an outer edge of the layer of material includes selecting a diameter of the needle and the thread and the proximity of placement of the cutting stitch to perform a cutting action of the layer of material.

* * * * *